United States Patent [19]

Marsilio

[11] Patent Number: 5,040,683

[45] Date of Patent: Aug. 20, 1991

[54] SHIPPING WEDGE, AND BLANK FOR FORMING SUCH A WEDGE

[75] Inventor: Ronald M. Marsilio, Mogadore, Ohio

[73] Assignee: American Standard Inc., New York, N.Y.

[21] Appl. No.: 547,778

[22] Filed: Jul. 3, 1990

[51] Int. Cl.[5] ..... B65D 81/04

[52] U.S. Cl. ..... 206/521; 206/320; 206/814

[58] Field of Search ..... 206/521, 814, 320

[56] References Cited

U.S. PATENT DOCUMENTS

| | | | |
|---|---|---|---|
| 2,609,136 | 9/1952 | Sider | 206/814 |
| 2,960,217 | 11/1960 | Nason . | |
| 3,072,313 | 1/1963 | Svendsen . | |
| 3,289,825 | 12/1966 | Smith . | |
| 3,421,451 | 1/1969 | Brucks | 206/521 |
| 3,424,108 | 1/1969 | Vargen | 206/521 X |
| 3,521,744 | 7/1970 | Smith . | |
| 3,752,384 | 8/1973 | Siburn | 206/521 |
| 3,900,101 | 8/1975 | Goodsite . | |
| 4,120,443 | 10/1978 | Gardner et al. | 206/814 |
| 4,148,396 | 4/1979 | Gardner | 206/814 |

*Primary Examiner*—William I. Price

*Attorney, Agent, or Firm*—John P. Sinnott

[57] ABSTRACT

A shipping wedge is provided for protecting articles during storage or shipment. The wedge is substantially trapezoidal in configuration and includes a slot extending from the top surface towards the bottom thereof. The slot is used for positioning the wedge with respect to a brace or other planar member and serves as a stop for limiting the extent to which the wedge may be inserted into a space. The shipping wedge is particularly applicable for protecting the apron of a bathtub from damage due to compression forces to which it may be subjected. If the apron is connected to the bathtub by means of a brace, the wedge is inserted such that the slot receives the brace and eventually engages it when the wedge has been fully inserted.

23 Claims, 4 Drawing Sheets

SHIPPING WEDGE, AND BLANK FOR FORMING SUCH A WEDGE

BACKGROUND OF THE INVENTION

1. Field of the invention.

The field of the invention relates to packaging materials for protecting items during storage or shipment.

2. Brief description of the related art.

The protection of valuable items from damage during storage and shipment is a well-recognized necessity. Various shipping containers and other packaging materials have accordingly been devised to protect such items.

The packaging of relatively large, bulky articles of irregular shape is difficult, particularly if such items are also heavy. Bathtubs are among such difficult-to-package articles.

One type of bathtub construction includes a reservoir and an apron which extends in front of the reservoir. Since there is a space between the apron and reservoir wall, the bathtub can be damaged if a force is exerted upon the apron.

U.S. Pat. Nos. 3,289,825 and 3,521,744 disclose shipping wrappers for bathtubs. The former patent discloses an apron sheet for protecting the apron of the bathtubs. U.S. Pat. No. 3,900,101 discloses a shipping container including a pair of opposing side flaps which engage the outer surface of a bathtub apron, thereby protecting the same.

SUMMARY OF THE INVENTION

It is an object of the invention to provide means for protecting an apron of a bathtub during storage or shipment.

It is another object of the invention to provide protecting means in the form of a shipping wedge which is resistant to compressive forces.

A still further object of the invention is to provide a shipping wedge which is easy and inexpensive to construct, light in weight, yet which has sufficient strength to withstand relatively large forces.

In accordance with these and other objects of the invention, a shipping wedge is provided which includes first and second opposing, converging side walls, and a bottom wall extending between the side walls. The bottom wall defines a bottom end of the shipping wedge. Means are provided for connecting the first and second side walls and defining a top end of the shipping wedge. In one form of the invention, an intermediate wall extends between the side walls and in opposing relation to the bottom wall. The side walls, bottom wall, means for connecting, and the intermediate wall may be formed from an integral strip of semi-rigid material. The wedge may alternatively be molded from a polymeric material. The means for connecting the first and second side walls preferably include a top wall extending parallel and in opposing relation to the intermediate wall. Such a shipping wedge may be used for preventing damage to an apron of a bathtub by positioning it between the apron and one of the walls of the reservoir of the bathtub. A slot preferably extends through the top portion of the wedge for accommodating a brace or web connecting the apron with a wall of the reservoir.

A blank for forming a shipping wedge is also provided by the invention. Such a blank includes an elongate, contiguous strip of semi-rigid material including first through twelfth sections arranged sequentially.

The sections are separated, respectively, from each adjoining section by eleven substantially parallel creases formed within the strip. The first through fifth sections are foldable, respectively, along four of the creases into a first substantially trapezoidal portion. The sixth through twelfth sections are foldable, respectively, along seven of the creases into a second substantially trapezoidal portion adjoining the first substantially trapezoidal portion in such a manner that the first and second substantially trapezoidal portions define a substantially trapezoidal overall construction.

DETAILED DESCRIPTION OF THE INVENTION

A shipping wedge 10 is provided for protecting articles which may be damaged during storage or shipment. The trapezoidal shape of the wedge 10 allows it to be positioned in spaces of various widths and to engage pairs of opposing walls which define such spaces. One size wedge may accordingly be used to package articles of different sizes.

Figure 1:
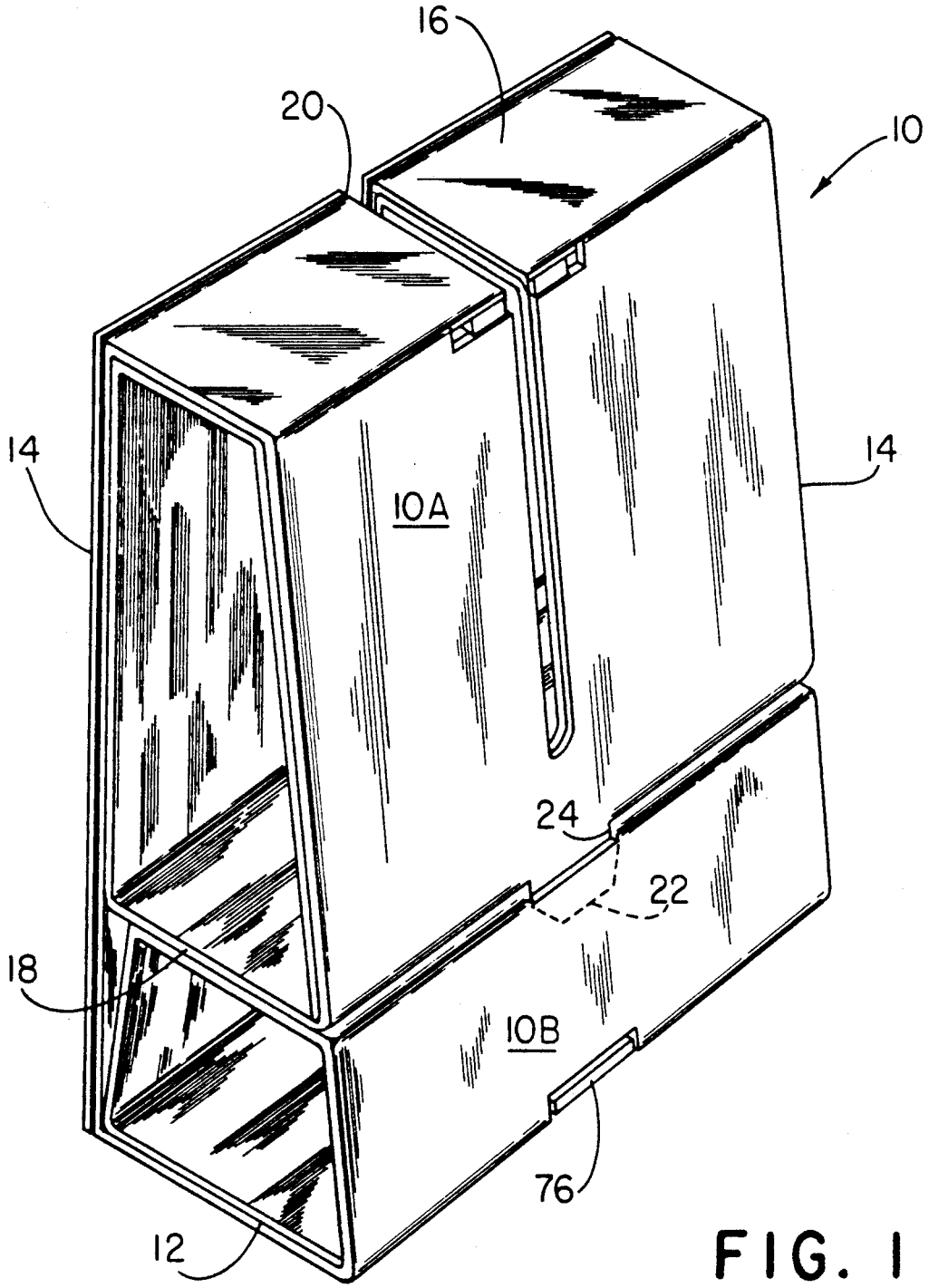
FIG. 1 is a top perspective view of a shipping wedge according to the invention.

Referring to FIG. 1, the wedge 10 includes a base 12, a pair of converging side walls 14, a top wall 16 connecting the side walls, and an intermediate wall 18 extending between the side walls and in opposing relation to the top wall and base, respectively. A slot 20 extends through the top wall and portions of the converging side walls. The slot may be used to receive braces, webs, or other structures which would otherwise preclude full insertion of the wedge into a space. It includes a pair of end portions positioned at least several inches above the base 12.

The shipping wedge 10 is defined by an upper wedge portion 10A and a lower wedge portion 10B. The upper wedge portion is supported by the top wall of the lower wedge portion. The two wedge portions are releasably secured to each other by a tab 22 which is integral with the upper wedge portion and a slot 24 in the lower wedge portion which receives the tab. Both of the wedge portions have substantially trapezoidal configurations. The lower wedge portion is substantially smaller in height than the upper wedge portion.

Figure 2:
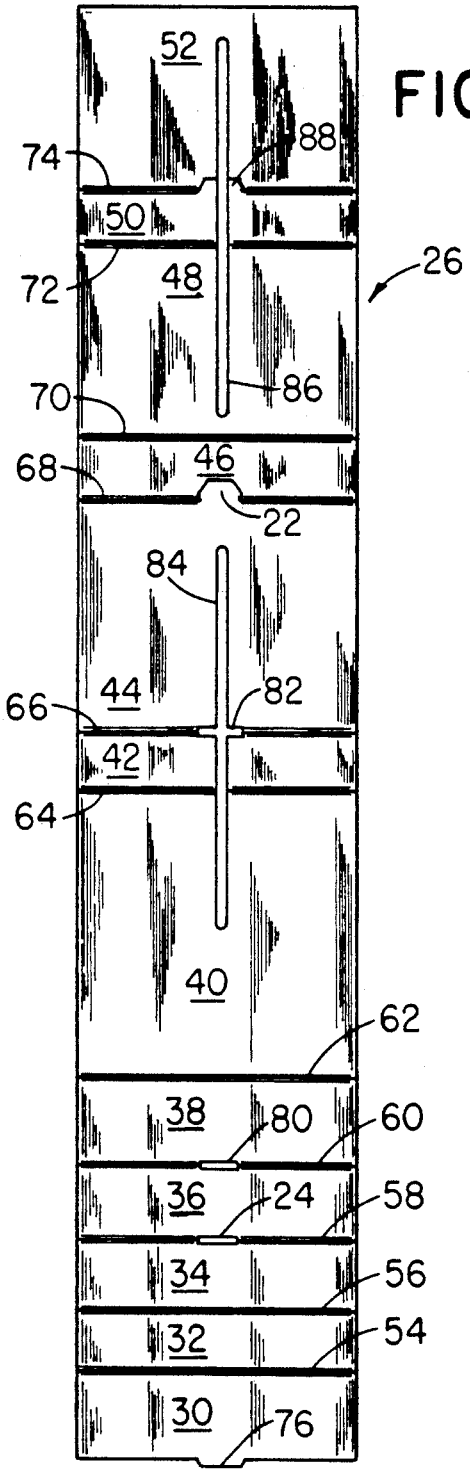
FIG. 2 is a top plan view of a blank employed for constructing a shipping wedge according to the invention.
Figure 3:
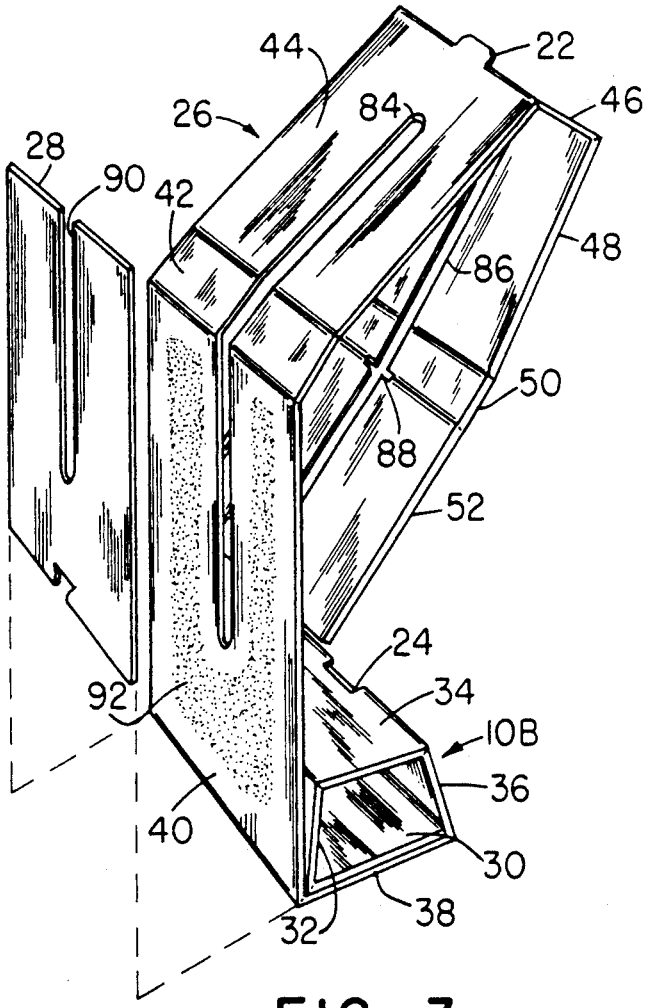
FIG. 3 is a top perspective view of the blank shown in FIG. 2 partially folded into the form of a shipping wedge.
Figure 4:
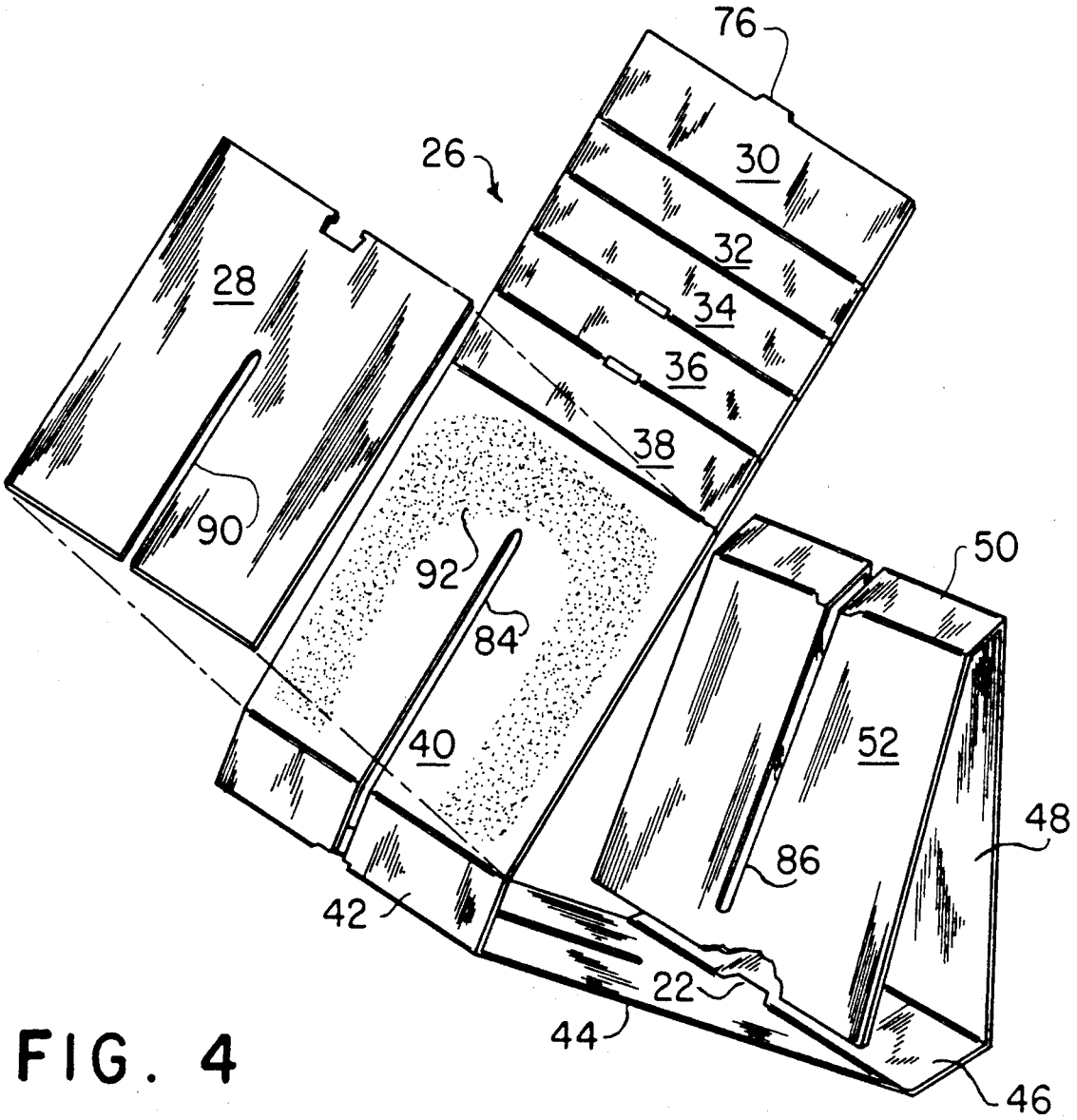
FIG. 4 is a bottom perspective view of the blank shown in FIG. 2 partially folded into the form of a shipping wedge.

Referring now to FIGS. 2–4, the shipping wedge is formed from a substantially rectangular, elongate blank 26 and a reinforcing wall 28 which is adhered to one of the surfaces of the blank. The blank and reinforcing wall are preferably made from a semi-rigid material such as corrugated cardboard.

The blank 26 includes twelve sections 30, 32, 34, 36, 38, 40, 42, 44, 46, 48, 50 and 52, which are arranged sequentially. The sections are separated, respectively, by eleven substantially parallel creases 54, 56, 58, 60, 62, 64, 66, 68, 70, 72, 74 formed within the blank. Sections 30–38 and a portion of section 40 define the lower wedge portion 10B when folded in the manner shown in FIG. 3. The remaining sections may be folded along creases 64–74 into the upper wedge portion 10A of the shipping wedge, as shown partially in FIG. 4.

Referring again to FIG. 2, one end section 30 of the blank 26 includes a tab 76 extending therefrom. First and second lateral slots 24, 80 extend through the third and fourth creases 58, 60, respectively. A third lateral slot 82 extends through a portion of the seventh crease 66. A first longitudinal slot 84 extends through the seventh section 42 and portions of the sixth and eighth sections 40, 44. A second longitudinal slot 86 extends through the eleventh section 50 and portions of the tenth and twelfth sections 48, 52.

A second tab 22 extends from the eighth section 44 into the ninth section. The ninth section is scored to form this tab. A third tab 88 extends from the eleventh section 50 into the twelfth section 52.

The reinforcing wall 28 is substantially rectangular and has substantially the same dimensions as the sixth section 40. It also includes a longitudinal slot 90 having substantially the same dimensions as the portion of the slot 84 extending through the sixth section 40 of the blank.

When the blank 26 is folded in the manner shown in FIG. 1, the resulting wedge 10 is locked together by the tabs 22, 76, 86 and associated slots 24, 80 and 82. As briefly discussed above, the tab 22 extending from the eighth section 44 of the blank is releasably locked within the first lateral slot 24 formed within the third crease 58. The tab 76 extending from the first section 30 of the blank is positioned within the slot 80 within the fourth crease 60. Finally, the tab 88 extending from the eleventh section 50 is positioned within the lateral slot 82 within the seventh crease 66.

The longitudinal slots 84, 86 are in registry with each other when the blank 26 is folded into the configuration shown in FIG. 1. The above-described slot 20 through the upper wedge portion 10A is formed by these slots 84, 86 and the slot 90 in the reinforcing wall 28. A layer of adhesive 92 is provided between the outer surface of the sixth section 40 of the blank and the reinforcing wall 28, and is used for securing the reinforcing wall to the wedge 10. A sturdy finished product is thereby provided which is resistant to deformation due to the materials employed and its structural configuration.

Figure 5:
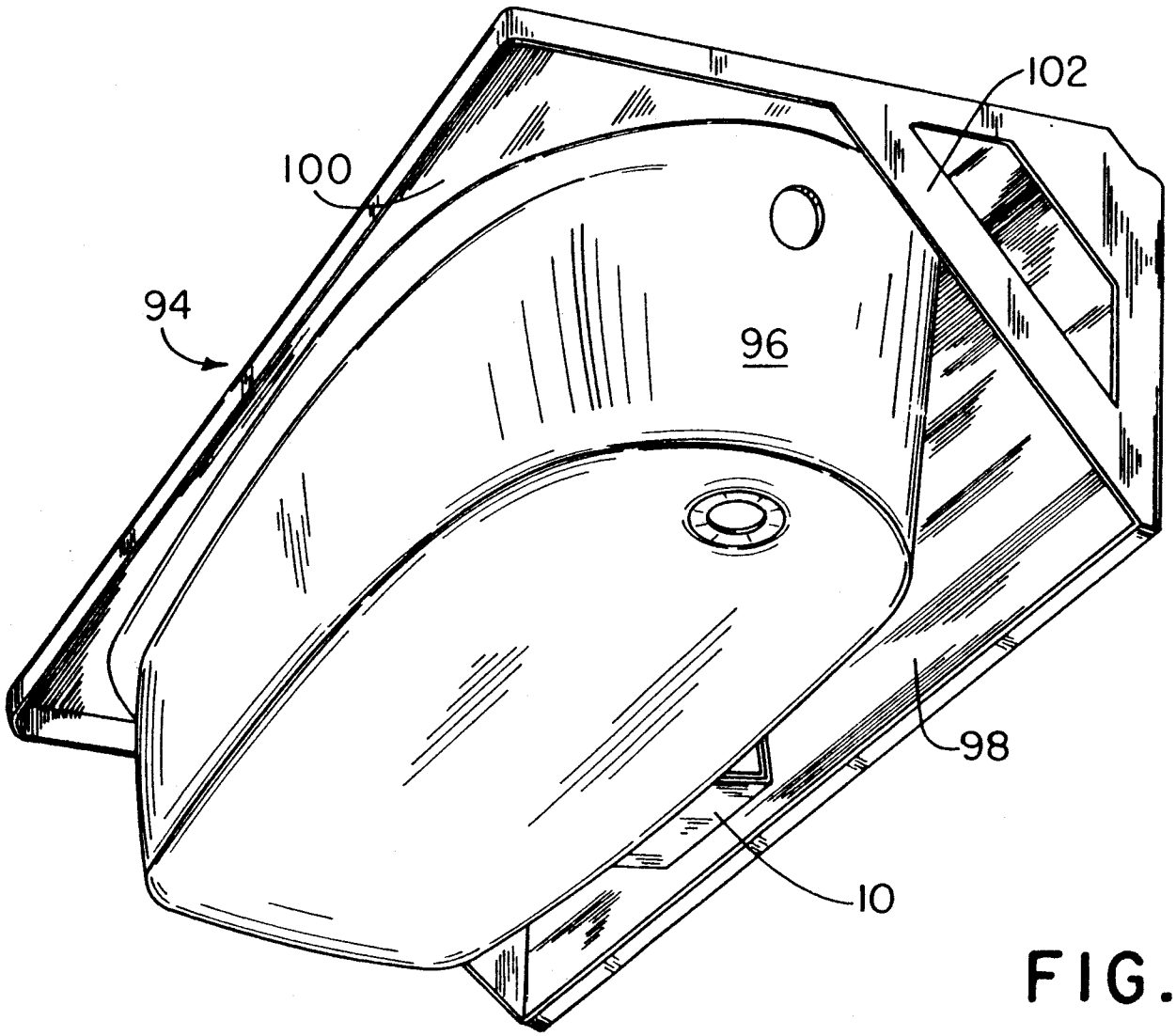
FIG. 5 is a bottom perspective view of a bathtub showing a shipping wedge positioned between an apron and a reservoir wall thereof.

A wedge 10 as described above is useful in preventing damage to structures such as bathtub aprons. Referring to FIG. 5, a bathtub 94 is shown which includes a reservoir 96, an apron 98, and a deck 100 defined about the reservoir opening and connecting the apron 98 to the reservoir 96. In the particular bathtub shown, three braces 102, one at each end of the bathtub and one in the middle, connect the deck and the apron. One of the three braces is visible in this Figure. It will be appreciated that additional or fewer braces may be employed, depending upon the construction of the bathtub.

The wedge 10 is positioned between a wall of the reservoir 96 and the inner surface of the apron 98. It is maintained in position by frictional engagement. The slot 20 allows the wedge to be fully inserted despite the presence of braces or similar obstructions. It also serves as a stop which prevents the wedge from being inserted too far into the space between the apron and reservoir wall. The side wall portions adjoining the ends of the slot 20 engage the brace, thereby preventing the wedge from being inserted so far that it causes the apron to bow outwardly. The apron can be damaged if caused to flex inwardly or outwardly. If a force is exerted upon the exterior surface of the apron, the wedge 10 (or wedges) absorb at least some of the force as the apron deflects inwardly. This prevents excessive movement of the apron and damage which might otherwise result therefrom.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A shipping wedge for protecting items during storage or shipment comprising:

first and second opposing, converging side walls;

a bottom wall extending between said side walls and defining a bottom end of said shipping wedge;

means for connecting said first and second side walls and defining a top end of said shipping wedge;

an intermediate wall extending between said side walls and in opposing relation to said bottom wall;

said side walls, bottom wall, means for connecting, and said intermediate wall being formed from an integral strip of semi-rigid material.

2. A shipping wedge as described in claim 1 including a slot extending through said top end and upper portions of said side walls.

3. A shipping wedge as described in claim 1 wherein said semi-rigid material is cardboard.

4. A shipping wedge as described in claim 3 wherein said cardboard is corrugated.

5. A shipping wedge as described in claim 1 wherein said intermediate wall includes first and second adjoining and substantially parallel intermediate wall sections, said first side wall includes a first side wall section and a second side wall section, said first side wall section extending between said means for connecting and said first intermediate wall section, said second side wall section extending between said bottom wall and said second intermediate wall section.

6. A shipping wedge as described in claim 5 wherein said means for connecting, said first side wall section of said first side wall, said first intermediate wall section, and an upper portion of said second side wall define an upper wedge portion, said bottom wall, said second side wall section of said first side wall, said second intermediate wall section, and a lower portion of said second side wall define a lower wedge portion, said upper wedge portion being releasably secured to said lower wedge portion.

7. A shipping wedge as described in claim 6 including a slot defined within said lower wedge portion, said first side wall section including a projection extending within said slot and releasably securing said upper wedge portion to said lower wedge portion.

8. A shipping wedge as described in claim 6 wherein said upper wedge portion is substantially greater in height than said lower wedge portion.

9. A shipping wedge as described in claim 1 wherein said intermediate wall is substantially closer to said bottom wall than to said means for connecting.

10. A shipping wedge as described in claim 1 wherein said means for connecting is a top wall extending between said side walls and in opposing relation to said intermediate wall.

11. A shipping wedge as described in claim 2 wherein said means for connecting is a top wall extending between said side walls and in opposing relation to said intermediate wall.

12. A shipping wedge as described in claim 5 wherein said means for connecting is a top wall extending between said side walls and in opposing relation to said intermediate wall.

13. A shipping wedge as described in claim 6 wherein said means for connecting is a top wall extending between said side walls and in opposing relation to said intermediate wall.

14. A shipping wedge for protecting items during storage or transportation, comprising:

a substantially trapezoidal body including a top surface, a bottom surface which is wider than said top surface, and a pair of converging side surfaces extending between said top surface and said bottom surface; and a slot extending through said top surface of said body and entirely across said body between said converging side surfaces such that said slot is capable of receiving a substantially planar body therein, said slot including an end portion positioned above said bottom surface.

15. A shipping wedge as described in claim 14 wherein said end portion of said slot is positioned at least several inches above said bottom surface.

16. A shipping wedge as described in claim 14 wherein said body is made from a semi-rigid material.

17. A shipping wedge as described in claim 14 wherein said body is formed from an integral strip of semi-rigid material folded into a trapezoidal configuration.

18. A shipping wedge as described in claim 17 wherein said body includes first and second converging side walls, a top wall extending between said side walls, a bottom wall extending between said side walls, and an intermediate wall extending between said side walls, said intermediate wall being positioned between and in opposing relation to said top and bottom walls.

19. A shipping wedge as described in claim 14 wherein said body includes first and second converging side walls, a top wall extending between said side walls, a bottom wall extending between said side walls, and an intermediate wall extending between said side walls, said intermediate wall being positioned between and in opposing relation to said top and bottom walls.

20. A shipping wedge as described in claim 19 wherein said intermediate wall is substantially closer to said bottom wall than to said top wall.

21. A blank for forming a shipping wedge, comprising:

an elongate, contiguous strip of semi-rigid material including first through twelfth sections arranged sequentially, said sections being separated, respectively, from each adjoining section by eleven substantially parallel creases formed within said strip, said first through fifth sections being foldable, respectively, along four of said creases into a first substantially trapezoidal portion, said sixth through twelfth sections being foldable, respectively, along seven of said creases into a second substantially trapezoidal portion adjoining said first substantially trapezoidal portion in such a manner that said first and second substantially trapezoidal portions define a substantially trapezoidal construction.

22. A blank as described in claim 21 including a first slot extending substantially longitudinally through said strip and a second slot extending substantially longitudinally through said strip, said first and second slots being alignable with each other upon folding said sixth through twelfth sections such that the trapezoidal construction formed upon folding said sections includes a slotted end.

23. A blank as described in claim 22 wherein said strip is substantially rectangular.

* * * * *